US008813791B2

(12) United States Patent
Gerth et al.

(10) Patent No.: US 8,813,791 B2
(45) Date of Patent: Aug. 26, 2014

(54) HIGH-SPEED SAFETY HEALD SHAFT

(71) Applicant: Groz-Beckert KG, Albstadt (DE)

(72) Inventors: Christian Gerth, Albstadt (DE); Bernd Pfeffer, Hoerikestrasse (DE); Ralph Simmack, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 29 days.

(21) Appl. No.: 13/622,708

(22) Filed: Sep. 19, 2012

(65) Prior Publication Data

US 2013/0068343 A1 Mar. 21, 2013

(30) Foreign Application Priority Data

Sep. 20, 2011 (EP) ..... 11182032

(51) Int. Cl.
*D03C 9/06* (2006.01)
*D03C 9/00* (2006.01)

(52) U.S. Cl.
CPC ..... *D03C 9/0675* (2013.01); *D03C 9/0633* (2013.01); *D03C 9/0658* (2013.01); *D03C 9/00* (2013.01); *D03C 9/065* (2013.01)
USPC ..... 139/87; 139/91; 139/92; 139/55.1

(58) Field of Classification Search
CPC .. D03C 9/0633; D03C 9/0691; D03C 9/0675; D03C 9/0666; D03C 9/0683; D03C 9/00; D03C 9/0658; D03C 9/0608; D03C 9/0616
See application file for complete search history.

(56) References Cited

U.S. PATENT DOCUMENTS

| | | | | | |
|---|---|---|---|---|---|
| 2,556,468 | A | * | 6/1951 | Consoletti | 139/92 |
| 2,676,619 | A | * | 4/1954 | Consoletti | 139/88 |
| 3,016,925 | A | * | 1/1962 | Graf | 139/92 |
| 3,335,759 | A | * | 8/1967 | Koch | 139/91 |
| 3,349,810 | A | * | 10/1967 | Goodman, Jr. | 139/92 |
| 3,753,450 | A | * | 8/1973 | Koch | 139/91 |
| 3,955,725 | A | * | 5/1976 | Rese | 224/194 |
| 4,015,639 | A | * | 4/1977 | Koch | 139/92 |
| 4,022,252 | A | * | 5/1977 | Ogura | 139/91 |
| 4,275,772 | A | * | 6/1981 | Shimizu | 139/91 |
| 4,493,521 | A | * | 1/1985 | Simon | 439/359 |
| 4,506,707 | A | * | 3/1985 | Shimizu | 139/91 |
| 4,590,344 | A | * | 5/1986 | Kikta et al. | 200/291 |
| 4,688,023 | A | * | 8/1987 | McGill et al. | 340/545.6 |
| 4,721,485 | A | * | 1/1988 | Suzuki | 440/77 |
| 4,741,367 | A | * | 5/1988 | Kitawaki | 139/91 |
| 4,832,088 | A | * | 5/1989 | Palau | 139/91 |
| 4,883,095 | A | * | 11/1989 | Maruyama et al. | 139/91 |

(Continued)

FOREIGN PATENT DOCUMENTS

| | | |
|---|---|---|
| CH | 427688 | 12/1966 |
| DE | 10116813 A1 | 10/2002 |
| EP | 2009158 A1 | 12/2008 |

OTHER PUBLICATIONS

European Search Report; EP11182032 dated Jun. 27, 2012; 5 pgs.

*Primary Examiner* — Bobby Muromoto, Jr.
(74) *Attorney, Agent, or Firm* — Fitch, Even, Tabin & Flannery LLP

(57) ABSTRACT

Guard elements (31) are provided for the corner connectors (16 through 19) of a heald shaft (10) of a shedding unit, the guard elements covering the open space formed between the two legs (26, 27) and thus providing a grip protection.

19 Claims, 4 Drawing Sheets

(56) References Cited

U.S. PATENT DOCUMENTS

| | | | | | |
|---|---|---|---|---|---|
| 5,004,019 | A * | 4/1991 | Blontrock | 139/91 |
| 5,063,971 | A * | 11/1991 | Peter | 139/87 |
| 5,152,324 | A * | 10/1992 | Froment | 139/82 |
| 5,249,605 | A * | 10/1993 | Graf | 139/91 |
| 5,335,699 | A * | 8/1994 | Beyaert et al. | 139/82 |
| 5,411,061 | A * | 5/1995 | Faase | 139/91 |
| 5,518,040 | A * | 5/1996 | Rupflin | 139/57 |
| 5,751,545 | A * | 5/1998 | Jung | 361/679.58 |
| 5,810,055 | A * | 9/1998 | Haeussler et al. | 139/57 |
| 5,887,629 | A * | 3/1999 | Mettler et al. | 139/91 |
| 7,617,844 | B2 * | 11/2009 | Schwane et al. | 139/91 |
| 7,624,763 | B2 * | 12/2009 | Drope et al. | 139/91 |
| 7,784,499 | B2 * | 8/2010 | Gesing et al. | 139/55.1 |
| 8,251,102 | B2 * | 8/2012 | Mettler | 139/93 |
| 8,596,304 | B2 * | 12/2013 | Gerth et al. | 139/50 |
| 2002/0124901 | A1 * | 9/2002 | Krumm | 139/57 |
| 2003/0016931 | A1 * | 1/2003 | Ferris et al. | 385/134 |
| 2003/0062093 | A1 | 4/2003 | Baumann | |
| 2004/0188125 | A1 * | 9/2004 | Wiggins | 174/58 |
| 2004/0206825 | A1 * | 10/2004 | Schmidt et al. | 235/462.46 |
| 2005/0081942 | A1 * | 4/2005 | Schwane et al. | 139/92 |
| 2005/0081943 | A1 * | 4/2005 | Olbing et al. | 139/92 |
| 2006/0043805 | A1 * | 3/2006 | Bradfield | 310/68 D |
| 2006/0070680 | A1 * | 4/2006 | Mettler | 139/93 |
| 2007/0006930 | A1 * | 1/2007 | Drope et al. | 139/11 |
| 2007/0009319 | A1 * | 1/2007 | Drope et al. | 403/11 |
| 2007/0062596 | A1 * | 3/2007 | Mettler | 139/82 |
| 2008/0135121 | A1 * | 6/2008 | Bruske et al. | 139/92 |
| 2008/0223601 | A1 * | 9/2008 | Johnson | 174/67 |
| 2009/0000687 | A1 * | 1/2009 | Gesing et al. | 139/84 |
| 2010/0012218 | A1 * | 1/2010 | Korbutt et al. | 139/91 |
| 2011/0255218 | A1 * | 10/2011 | Pakula et al. | 361/679.01 |

* cited by examiner

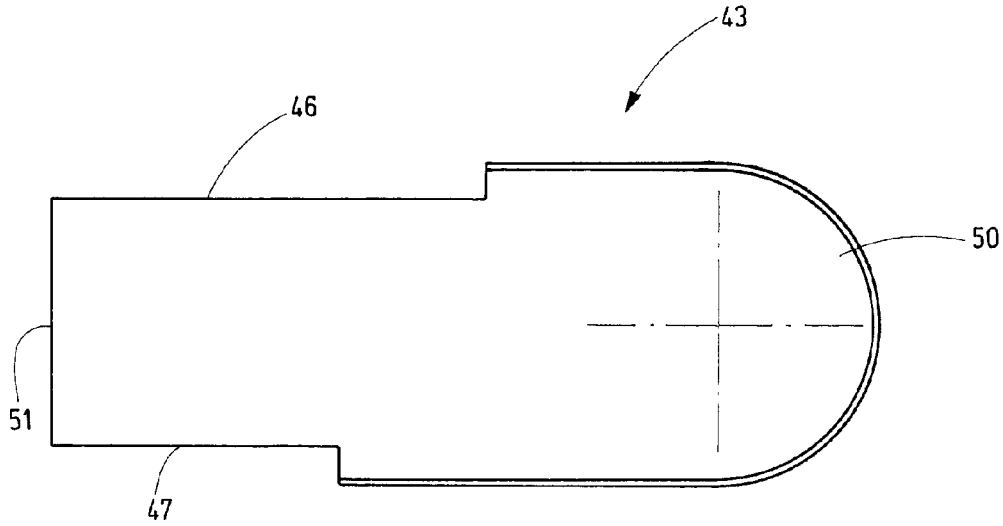
Fig.5
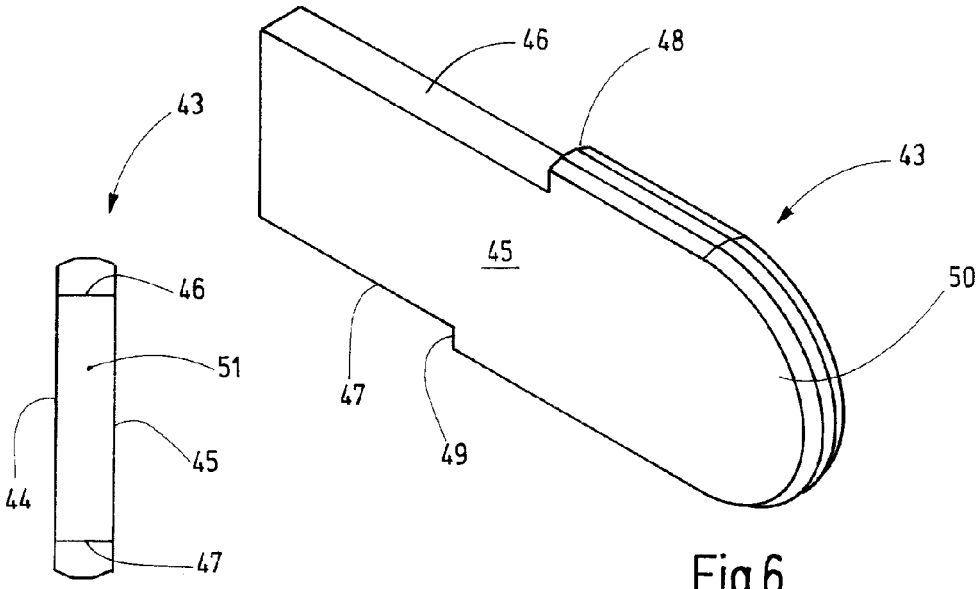
Fig.6
Fig.7

HIGH-SPEED SAFETY HEALD SHAFT

TECHNICAL FIELD

The invention relates to a heald shaft for weaving machines.

BACKGROUND

So-called heald shafts are arrangements in the form of a frame comprising a long, horizontal upper shaft rod and, located beneath the latter, a long, horizontal lower shaft rod. The ends of the two shaft rods are connected to each other by lateral supports. The shaft rods support heald-bearing rails on which the healds a seated. For mounting and removing the healds, the heald shaft must be designed so as to be demountable. To accomplish this, the lateral supports are removable. Releasable corner connectors are used for connecting the shaft rods with the lateral supports. Relevant examples have been known, for example, from publication DE 10 2005 029 701 B3 or also from DE 103 49 381 B4.

Publications CH 427688 A, as well as DE 101 16 813 B4 disclose the principle of a corner connector having two clamping legs machined out of the shaft rod, whereby an extension of the lateral support is clamped in place between said clamping legs.

The object of the invention is to minimize risks posed to the operator, said risks being caused by the heald shafts.

In particular when a weaving machine is being set up in the case of interruptions of operation due to operational troubles or on account of other situations, operators must have access to the heald shafts, in which case at least a slow movement of the heald shafts must also be possible. In those cases, there must be effective measures to prevent the operators from being injured or from being otherwise harmed.

SUMMARY

It is the object of the invention to provide a heald shaft exhibiting improved safety.

The heald shaft in accordance with the invention comprises at least one corner connector that includes a hollow space that is open toward one of the flat sides of the shaft rod. The hollow space is delimited by two legs that preferably are part of the shaft rod and preferably have a length that is clearly greater than the length of the extension of the lateral support, said extension being accommodated between said legs. In so far, there remains a considerable opening that extends through the lateral surface. The guard element arranged on or in the opening blocks the access to the opening so that tools or clothing or the fingers of an operator cannot enter this opening. Consequently, the risk of injury when manipulating the heald shaft is considerably reduced.

Preferably, the legs have clamping jaws that can be tension-clamped relative to each other via a tensioning means in order to clamp the extension of the lateral support in place between said clamping jaws. These clamping jaws may consist of a solid material, in particular metal, e.g., steel. Independent thereof, the heald shafts may consists of another material, preferably aluminum. The clamping jaws may be connected to the legs in a stationary or movable manner. Between the clamping jaws there is a distance that, preferably, is several centimeters but, at any rate, large enough to prevent the average operator from reaching with the thumb or finger between the clamping jaws if there were no guard element.

Preferably, the extension takes up less than half the volume of the opening. In the preferred embodiment, the extension takes up less than one third of the volume. Consequently, the extension is only clamped between the ends of the legs, while the largest part of the opening remains unblocked. The thusly relatively long legs pivot only very minimally when tensioned so that the extension clamped between them is subject to a uniform pressure per unit area and thus there is a transmission of force over a large area.

At least the larger part of the opening is covered by the guard element. Preferably, the coverage is complete. Alternatively, it is possible that smaller areas or openings also remain unblocked, these areas and openings being so small that an operator cannot reach inside of them with his finger. To this extent, the guard element can be configured as a cohesive, planar element, as well as—alternatively—as an element with one or more smaller openings.

Preferably, the guard element is held on the heald shaft by means of at least one fastening element. The fastening element may be, for example, a detent finger extending transversely through the opening. Whereas the guard element preferably abuts around the rim of the opening against one of the flat sides, the detent finger preferably extends behind the other flat side. It has been demonstrated that this type of fastening allows a simple attachment of the guard element to the shaft rod and also ensures that the guard element does not loosen by itself, even in instances of high accelerations of the shaft rod.

Alternatively, other means may be used to fasten the guard element to the shaft rod. For example, said guard element may be fastened to the shaft rod with glue or an adhesive. However, in doing so, said guard element extends at least along part of the rim belonging to the flat side and enclosing the opening and is glued to the flat side at that site.

However, the guard element may also be a body that is arranged and held in the opening. Fastening may again be made possible by clamping or gluing, or also by engagement.

Independent of its design, the guard element is preferably made of a plastic material, e.g., or a transparent or an opaque plastic material. Preferably, the guard element is resilient to the extent that it does not hinder the minimal relative movement of the legs that delimit the opening, said movement occurring when the extension of the lateral support is being clamped in place or released.

BRIEF DESCRIPTION OF THE DRAWINGS

Details and modifications, as well as advantageous specific features of the embodiments of the present invention are obvious from the description, the subordinate claims, as well as from the drawings. They show in:

FIG. 5 a side view of an alternative embodiment of the guard element;

FIG. 6 a perspective view of the guard element as in FIG. 5;

FIG. 7 a front view of the guard element as in FIGS. 5 and 6;

DETAILED DESCRIPTION

Figure 1:
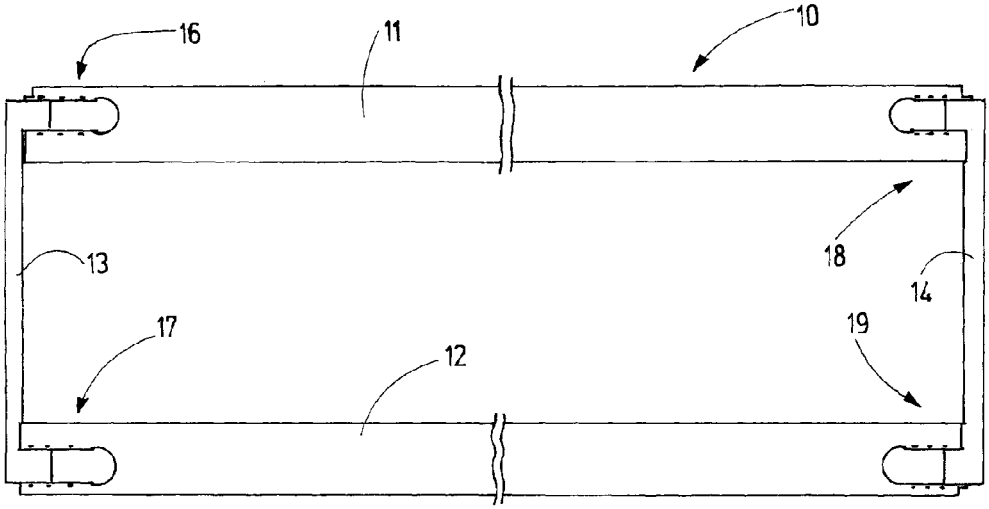
FIG. 1 a schematic front view of a heald shaft.
Figure 2:
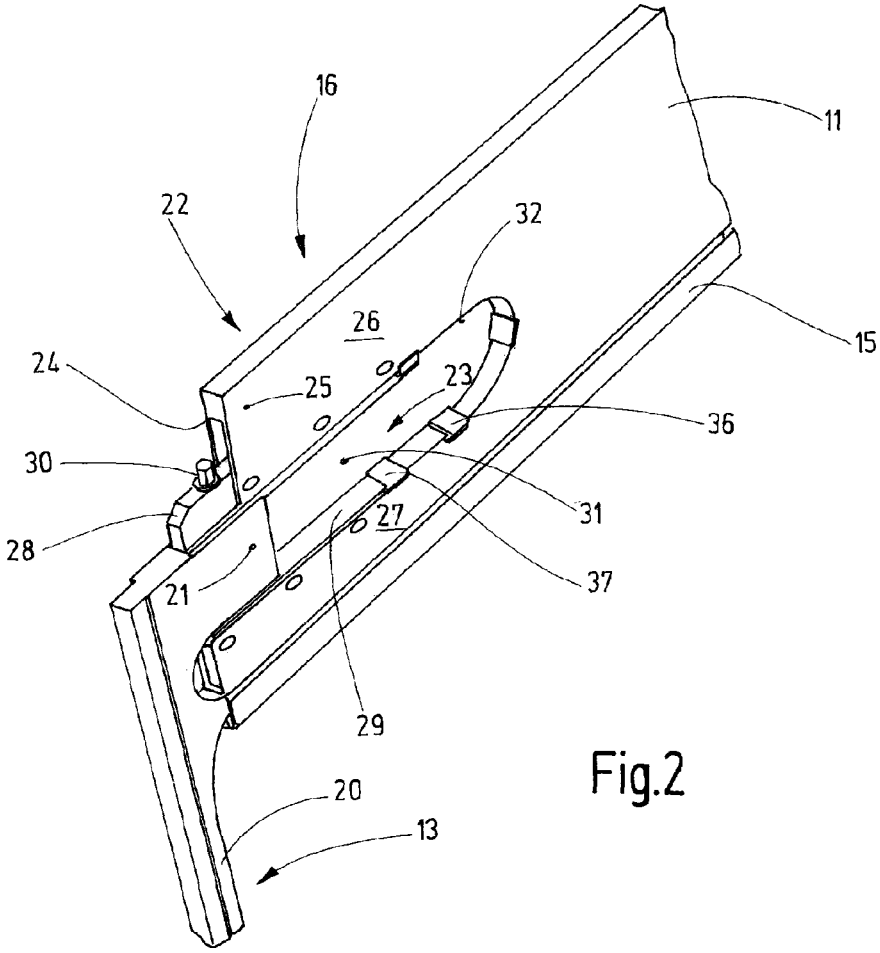
FIG. 2 a perspective view of a corner region of the heald shaft as in FIG. 1.

FIG. 1 shows a schematic of a heald shaft 10. It comprises an upper shaft rod 11 and a lower shaft rod 12, said rods being arranged parallel at a distance from each other. The shaft rods 11, 12 are connected to each other by a left lateral support 13 and a right lateral support 14. Consequently, a rectangular frame is formed, in which not specifically illustrated healds are arranged. The shaft rods 11, 12 bear heald bearing rails for the accommodation of the healds. FIG. 2 shows the heald bearing rail 15 of the upper shaft rod 11. Whereas the shaft rod 11 is a narrow, high aluminum profile having an approximately rectangular cross-section, the heald bearing rail 15 is preferably made of steel. Alternatively, the shaft rod 11 may be made of other materials, e.g., also fiber-reinforced plastic materials or the like. Corner connecting devices 16 through 19 are provided for the connection between the lateral supports 13, 14 and the shaft rods 11, 12, each of said corner connecting devices having the same type of configuration. Accordingly, the description of the corner connecting device 16 is representative of the other corner connecting devices 17 through 19.

FIG. 2 shows the upper end of the left lateral support 13 and the left end of the upper shaft rod 11. In so far, the corner connecting device 16 is shown in particular.

During use, the lateral support 13 extends in vertical direction and is guided in the weaving machine so as to be vertically movable. Said lateral support has an essentially straight shaft 20 from the top of which extends a horizontal extension 21, e.g., at a right angle relative to the shaft 20. The extension 21 has a rectangular cross-section, for example. Preferably said extension has a horizontal thickness that is not greater than the low thickness of the upper shaft rod 11.

The end 22 of the shaft rod 11 is provided with an opening 23 that extends from the face-end side into the shaft rod 11 and also through its two flat sides 24, 25. In so far, a mouth-like opening is formed, said opening being delimited by its upper leg 26 and by a lower leg 27. Preferably, the two legs 25, 27 are provided with clamping pieces 28, 29 that, e.g., may consist of steel or solid aluminum or of another material. While the shaft rod 11 can be configured as a light-weight hollow profile, the clamping pieces 28, 29 are preferably solid. The latter can be riveted or screwed together, or otherwise connected together. The distance between the clamping surfaces of the clamping legs 28, 29, said surfaces facing each other and being preferably planar, preferably essentially matches the distance between the upper and lower surfaces of the extension 21. Consequently, the extension 21 can easily be inserted between the legs 26, 27.

Whereas the upper clamping piece 28 has a passage opening, the lower clamping piece 29 has a threaded bore in alignment with said passage opening. The extension 21 has a passage bore in alignment with these bores. Consequently, a tensioning means, e.g., in the form of a pulling bolt 30 or another element, can be passed through the bores and screwed into the threaded bore of the lower clamping piece 29. When the pulling bolt 30 is tightened, the legs 26, 27 move minimally in a resilient manner, and the extension 21 is clamped in place between the two clamping pieces 28, 29.

Figure 3:
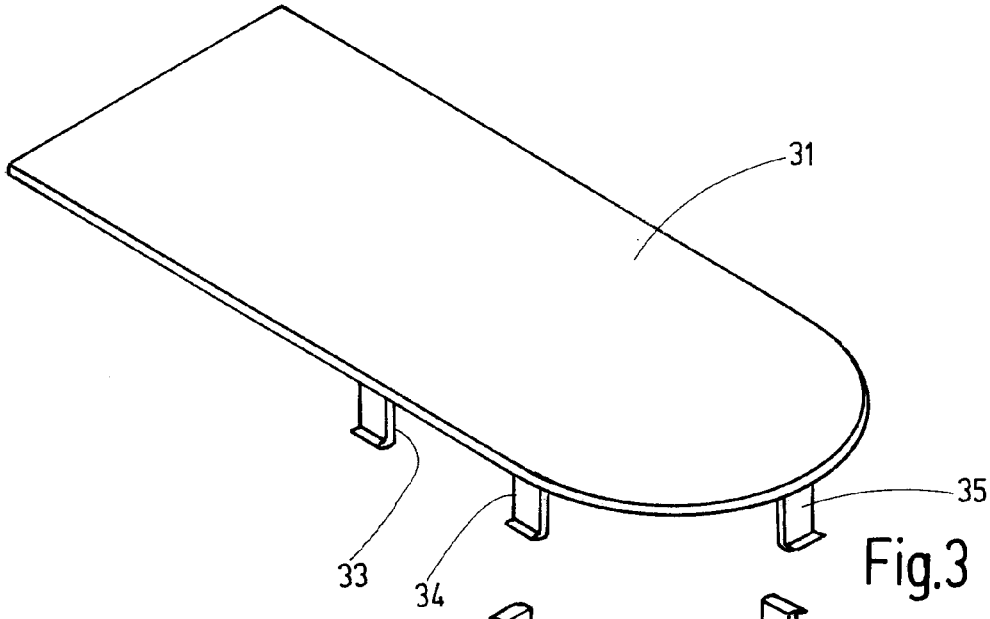
FIGS. 3 and 4 perspective representations of the guard element for the corner region of the heald shaft.
Figure 4:
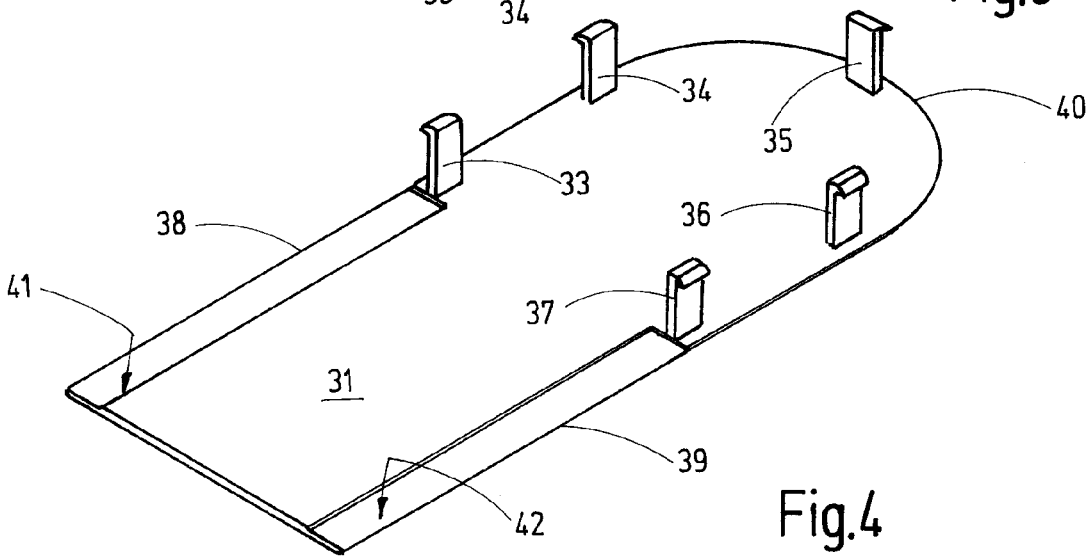

Ideally, this function is achieved when the opening 23 has a depth measured in horizontal direction away from the face-side end of the shaft rod 11, said depth being substantially greater than the length of the extension 21 measured in the same direction. In so far, the large part of the opening 23 remains open toward the flat sides 24, 25, respectively. A guard element 31 is provided for covering the remaining opening 23 at least toward one of the flat sides 24, 25, said guard element covering the opening 23 toward the flat side 24 in the present exemplary embodiment. FIGS. 3 and 4 are separate illustrations of the guard element 31. For example, said guard element is a thin plate of plastic material that is configured so as to match the shape of the opening 23. Said plate of plastic material extends over the rim 32 of the opening 23 and, accordingly, abuts against the rim-end portion of the flat side 24. For example, mounting claws 33 through 37 configured as detent fingers extend approximately at a right angle away from the side of the plate-shaped body of the guard element 31, said side facing the opening 23. On their respectively free ends, the mounting claws 33 through 37 are provided with detent dogs or other projections that are able to extend behind the rim of the opening 23 in order to hold the guard element 31 in place on the opposite flat side 25. The mounting claws 33 through 37 are arranged so as to follow the rim 32 of the opening 23.

Preferably, the opening 23 is delimited by legs that are parallel with respect to each other and have straight edges. These two straight edges terminate in each other in an arcuate end section. Accordingly, the plate-shaped base body of the guard element 31 is provided with two straight edges 38, 39 that are parallel to each other and are connected to each other by an arcuate edge section 40, said section preferably being shaped like a circular arc. Adjacent to the straight edges 38, 39, the thickness of the plate-shaped base body of the guard element 31 may be reduced. In doing so, grooves 41, 42 having open edges are formed, said grooves being disposed to accommodate laterally projecting parts of the clamping pieces 28, 29.

As is particularly obvious from FIG. 3, the thickness of the plate-shaped base body of the guard element 31 is low. On the side facing toward the outside in FIG. 3, top, said element is preferably planar. The guard element 31 is arranged on the heald shafts mounted in a weaving machine, preferably on the heald shafts located on the outside in the heald shaft group, preferably on the outward facing flat side of said outside heald shafts. In this manner, an operator is prevented from inadvertently reaching into the opening 23 and being bruised when the machine is started up or even when the machine is in slow operating mode, e.g., when it is being set up. The same types of heald shafts are arranged in close proximity to each other in the weaving machine. An operator's finger reaching through the openings 23 of adjacent heald shafts would otherwise be bruised, injured or severed in case of a relative movement of the heald shafts.

It is also possible to design the guard element 31 in a different way. FIGS. 5 through 7 show an alternative embodiment of a guard element 43 that is configured as a filler body. Said body is to be arranged in the opening 23 and thus blocks access to said opening from the flat side. The filler body 43 has a shape that is adapted to the shape of the opening 23. FIG. 7 shows the thickness of the guard element 43. The thickness to be measured between the two flat sides 44, 45 of said guard element preferably corresponds to the thickness of the shaft rod 11 to be measured between the two flat sides 24, 25. In addition, the filler body 43 has an upper and a lower narrow surface 46, 47 that are disposed to come into abutment with the clamping pieces 28, 29. At the end of the narrow surface 46 there is a step 48 at which the height of the filler body 43 increases. A corresponding step 49 is provided adjoining the lower narrow surface 47. The steps 48, 49 are adjoined by an initially straight and then arcuate rim 50 that extends behind the lateral walls of the shaft rod 11 and thus secures the filler body 43 in the opening 23.

When in use, the filler body 43 fills the opening 23 to such an extent that the extension 21 will still just fit between the clamping pieces 28, 29. The face-side narrow surface 51 of the filler body 43 abuts against the front of the extension 21 or is held at a minimal distance therefrom.

The filler body 43 may consist of a solid plastic material, a foamed material or the like. It is—at least minimally—flexibly resilient in order to not hinder a slight, springy movement of the legs 26, 27. The filler body 43 may be secured in the opening 23 in a form-fitting manner and may optionally also be supporting by material bonding, e.g., with a glue or adhesive material. In addition, it is possible to provide other fastening means such as, e.g., fastening clips, projections, dogs or the like.

Figure 8:
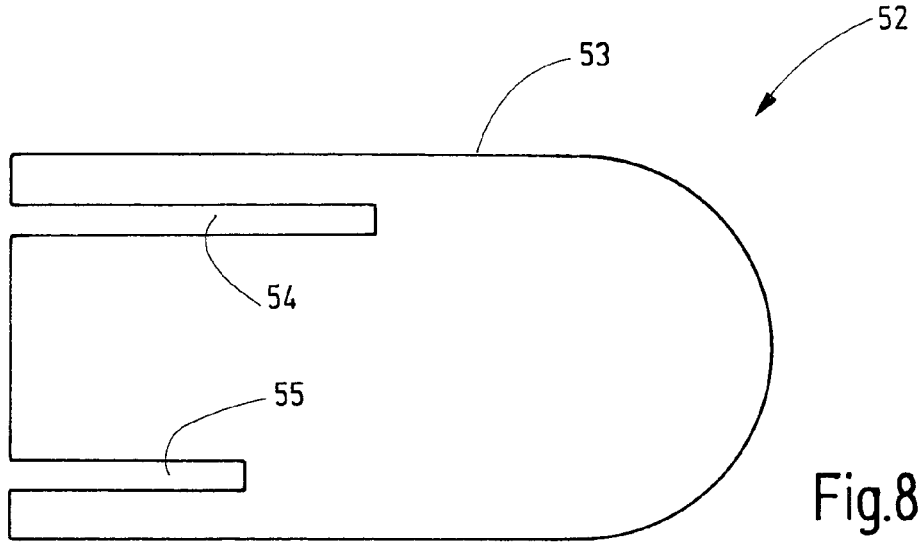
FIG. 8 a side view of an alternative embodiment of the guard element in accordance with the invention.
Figure 9:
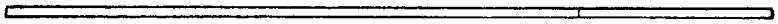
FIG. 9 a plan view of the guard element as in FIG. 8.
Figure 10:
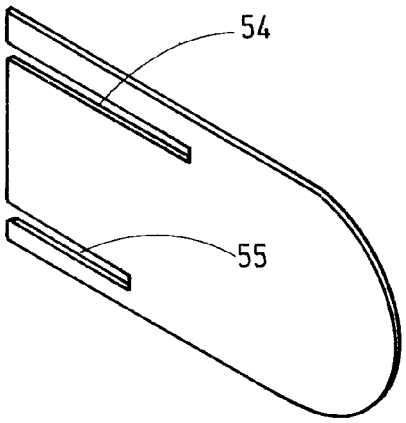
FIG. 10 a perspective view of the guard element as in FIGS. 8 and 9.

FIGS. 8 through 10 show another alternative embodiment of a guard element 52. In this case, the guard element 52 is configured as an adhesive element. Preferably, said guard element has the shape of a thin plate of uniform thickness with a contour 53 that is adapted to the shape of the opening 23. The dimensions of this contour are such that the guard element 52 extends over the rim 32 of the opening 23. Longitudinally extending slits 54, 55 may be provided in order to accommodate or allow the passage of parts of the clamping pieces 28, 29, said parts projecting laterally beyond the flat sides 24, 25. The lengths of the slits 54, 55 that are parallel to each other are adapted to the length of the clamping pieces 28, 29.

The adhesive elements 52 may be secured by means of an adhesive on one of the flat sides 24, 25 or also on both flat sides 32 on the rim 32 of the opening 23 and may remain permanently on the shaft rod 11. As needed, it is possible to provide one or more heald shafts of a shedding unit with guard elements having one or more of the aforementioned designs. In particular, it is recommendable that the outward-facing flat sides of the heald shafts located on the outside of a shedding arrangement be provided with guard elements of the mentioned type. In doing so, an effective grip protection is accomplished. An adequate grip protection may already exist when only the shaft rods at the top during use are equipped with guard elements.

Guard elements 31 are provided for the corner connectors 16 through 19 of a heald shaft 10 of a shedding unit, said guard elements covering the open space formed between the two legs 26, 27 and thus providing a grip protection.

LIST OF REFERENCE SIGNS

10 Heald shaft
11 Upper shaft rod
12 Lower shaft rod
13 Left lateral support
14 Right lateral support
15 Heald bearing rail
16-19 Corner connecting devices
20 Shaft
21 Extension
22 End
23 Opening
24 Flat side
25 Flat side
26 Upper leg
27 Lower leg
28 Upper clamping piece
29 Lower clamping piece
30 Tensioning means, pulling bolt
31 Guard element
32 Rim
33-37 Mounting claws
38 Straight edge
39 Straight edge
40 Edge section
41 Groove
42 Groove
43 Guard element/filler body
44 Flat side
45 Flat side
46 Narrow surface
47 Narrow surface
48 Step
49 Step
50 Rim
51 Face-side narrow surface
52 Guard element/adhesive element
53 Contour
54 Slit
55 Slit

What is claimed:

1. Heald shaft for a weaving machine, the heald shaft comprising:

a shaft rod with two flat sides, said shaft rod having, on one end, an opening delimited by one of two legs, said opening extending through the flat sides of the shaft rod, a lateral support with an extension extending into the opening, said extension not filling the opening, at least one guard element configured to engage an outer portion of the opening of at least one of the flat sides to substantially block access to the opening.

2. The heald shaft as in claim 1, further comprising clamping pieces fastened to the legs, wherein said clamping pieces are configured to be tensioned relative to each other via a tensioning means to clamp the extension in place between the legs.

3. The heald shaft as in claim 1, characterized in that the extension takes up less than half of the volume of the opening.

4. The heald shaft as in claim 1, characterized in that the guard element comprises a planar element extending over the flat-side rim of the opening.

5. The heald shaft as in claim 4, characterized in that the guard element comprises at least one fastening element extending transversely through the opening.

6. The heald shaft as in claim 5, characterized in that the fastening element comprises a detent finger.

7. The heald shaft as in claim 6, characterized in that the detent finger comprises a detent dog abutting against one of the flat sides.

8. The heald shaft as in claim 1, characterized in that the guard element is fastened to the shaft rod by means of a glue or adhesive material.

9. The heald shaft as in claim 1, characterized in that the guard element is configured to allow an elastic relative movement of the legs.

10. The heald shaft as in claim 1, characterized in that the guard element comprises a body arranged in the opening.

11. Heald shaft for a weaving machine, the heald shaft comprising:

a shaft rod with two flat sides, said shaft rod having, on one end, an opening delimited by one of two legs, said opening extending through the flat sides of the shaft rod, a lateral support with an extension extending into the opening, said extension not filling the opening, at least one guard element that blocks access toward the opening of at least one of the flat sides, clamping pieces fastened to the legs, wherein the clamping pieces are configured to provide clamping surfaces at edges of the opening and to be tensioned relative to each other to clamp the extension in place between the legs.

12. The heald shaft as in claim 11, characterized in that the extension takes up less than half of the volume of the opening.

13. The heald shaft as in claim 11, characterized in that the guard element comprises a planar element extending over the flat-side rim of the opening.

14. The heald shaft as in claim 13, characterized in that the guard element comprises at least one fastening element extending transversely through the opening.

15. The heald shaft as in claim 14, characterized in that the fastening element comprises a detent finger.

16. The heald shaft as in claim 15, characterized in that the detent finger comprises a detent dog abutting against one of the flat sides.

17. The heald shaft as in claim 11, characterized in that the guard element is fastened to the shaft rod by a glue or adhesive material.

18. The heald shaft as in claim 11, characterized in that the guard element is configured to allow an elastic relative movement of the legs.

19. The heald shaft as in claim 11, characterized in that the guard element comprises a body arranged in the opening.

* * * * *